US007295800B2

(12) United States Patent
Soures et al.

(10) Patent No.: US 7,295,800 B2
(45) Date of Patent: Nov. 13, 2007

(54) SYSTEMS AND METHODS TO ASSIST IN STRIPPING A SUBSTRATE FROM AN IMAGE TRANSFER UNIT

(75) Inventors: Michael Nicholas Soures, Webster, NY (US); Robert Arnold Gross, Penfield, NY (US)

(73) Assignee: Xerox Corporation, Stamford, CT (US)

( * ) Notice: Subject to any disclaimer, the term of this patent is extended or adjusted under 35 U.S.C. 154(b) by 249 days.

(21) Appl. No.: 11/209,557

(22) Filed: Aug. 23, 2005

(65) Prior Publication Data

US 2007/0048033 A1 Mar. 1, 2007

(51) Int. Cl.
*G03G 15/16* (2006.01)

(52) U.S. Cl. ..... 399/315

(58) Field of Classification Search ..... 399/315–317, 399/398, 399

See application file for complete search history.

(56) References Cited

U.S. PATENT DOCUMENTS 4,190,348 A 2/1980 Friday
4,239,373 A 12/1980 Weikel, Jr.
4,979,000 A * 12/1990 Hamada et al. ..... 399/315
5,298,954 A 3/1994 Fujita et al.
5,592,298 A 1/1997 Caruso
5,839,024 A 11/1998 May et al.
5,923,921 A 7/1999 OuYang et al.
6,115,560 A 9/2000 Kuek et al.
6,327,445 B1 12/2001 Honda et al.
6,345,168 B1 2/2002 Pitts
6,510,296 B2 1/2003 Less et al.
6,807,389 B2 10/2004 Facci et al.
6,871,029 B2 3/2005 Brewington et al.

* cited by examiner

*Primary Examiner*—Susan Lee
(74) *Attorney, Agent, or Firm*—Maginot, Moore & Beck

(57) ABSTRACT

A method for assisting in stripping a substrate from a charge receptor that is operable to transfer marking material to the substrate at a transfer zone, comprising determining the solid area coverage of the transfer marking material at a leading region of the substrate at the leading edge thereof, moving the substrate through the transfer zone, and applying a stripping force to the leading region of the substrate as a function of the solid area coverage operable to at least partially strip the leading region of the substrate from the charge receptor when the leading region of the traverses the transfer zone.

20 Claims, 4 Drawing Sheets

SYSTEMS AND METHODS TO ASSIST IN STRIPPING A SUBSTRATE FROM AN IMAGE TRANSFER UNIT

TECHNICAL BACKGROUND

The present disclosure relates to systems and methods for stripping a substrate from an image transfer unit, such as photoreceptors found in printers, photocopiers, facsimile machines and the like.

One type of known printing system or digital imaging system is depicted in FIG. 1. Printing jobs are submitted from a print controller client 10 to a print controller 12. The print controller client 10 may be an electronic copier, printer, facsimile or computer that creates or transmits digital image data. A pixel counter 14 is incorporated into the print controller to count the number of pixels to be imaged with toner on each sheet or page of the job, for each color. The pixel count information is stored in a memory of the print controller 12. Job control information, including the pixel count data and digital image data, are communicated from the print controller 12 to a control unit 20. The digital image data represents the desired output image to be imparted on at least one sheet of a substrate. The control unit 20 may be a microprocessor or other control device.

A photoreceptor surface 26 advances sequentially through various xerographic process stations in the direction indicated by arrow 26. The surface 26 may be a charge retentive surface on a photoreceptor belt, such as an active matrix photoreceptor belt. Other types of photoreceptors, such as a photoreceptor drum, may be substituted for the belt 26 for sequentially advancing through the xerographic process stations. A portion of the photoreceptor belt 26 passes through charging station A, where a charging unit 28 charges the photoconductive surface of photoreceptor belt 26 to a substantially uniform potential. Preferably, charging unit 28 is a corona-generating device such as a corotron.

Subsequently, the charged portion of photoreceptor belt 26 is advanced through imaging/exposure station B. The control unit 20 receives the digital image data from the print controller, processes and then transmits this digital image data to an exposure device 30 located at imaging/exposure station B. The device may be a raster output scanner (ROS) or other xerographic exposure device, such as a plurality of light emitting diodes (an LED bar). The output of the exposure device causes the charge retentive surface of the photoreceptor belt 26 to be discharged at certain locations on the belt in accordance with the digital image data output from the digital image generating device. Thus, a latent image is formed on photoreceptor surface 26.

Next, the photoreceptor surface 26 advances the latent image to a development station C, where toner is electrostatically attracted to the latent image using commonly known techniques. The latent image attracts toner particles contained in a developer unit 36, forming a toner powder image thereon. Alternatively,the developer unit 36 may utilize a hybrid development system in which the developer roll, better known as the donor roll, is powered by two developer fields (potentials across the air gap). The first field is the ac field which is used for toner cloud generation. The second field is a dc developer field which is used to control the amount of toner mass developed on the photoreceptor belt 26. Appropriate developer biasing is accomplished by way of a power supply. This type of system is a non-contact type in which only toner particles are attracted to a latent image and there is no mechanical contact between the photoreceptor belt 26 and the toner delivery device. However, the developer unit 36 may utilize a contact system as well.

Subsequent to image development, a substrate S is moved into contact with toner images at transfer station D. The substrate S is obtained from a supply and advanced to transfer station D by any known sheet feeding apparatus (not shown). The substrate S is then brought into contact with the photoconductive surface of photoreceptor belt 26 in a timed sequence so that the toner powder image developed thereon contacts the advancing substrate S at transfer station D. Transfer station D preferably includes a transfer unit 40. Transfer unit 40 may include a corona-generating device, such as a corotron. The corona-generating device sprays ions onto the backside of substrate S. These ions attract the oppositely charged toner particle images from the photoreceptor belt 26 onto the substrate S. A detack unit 46, such as a detack corotron, is provided for facilitating stripping of the substrate S from the photoreceptor belt 26.

After transfer, the substrate S continues to advance toward fuser station E on a conveyor belt (not shown) in the direction of arrow 44. Fuser station E includes a fuser unit 42, which includes fuser and pressure rollers to permanently affix the image to the substrate S. After fusing, the substrate is the advanced in a known manner to a catch tray, stacker, finisher or other output device (not shown), for subsequent removal from the print engine by the operator.

After the substrate S is separated from photoconductive surface of photoreceptor belt 26, the residual toner particles carried by the non-image areas on the photoconductive surface are removed therefrom. These particles are removed at cleaning station G, using, for example, a cleaning brush or plural brush structure or any number of well known cleaning systems.

Control unit 20 regulates the various print engine functions. The control unit 20 is preferably a programmable controller (such as a microprocessor), which controls the print engine functions. The control unit 20 may provide a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by an operator.

As is known, as a portion of the photoreceptor belt 26 passes through the charging station A, the charging unit 28 charges the photoconductive surface of the belt portion to a relatively high, substantially uniform potential. This potential is conventionally a negative voltage $-V_0$, which is typically between −600V and −600V. At the imaging station B, the charged portion of the photoconductive surface is exposed to the scanning device 30, which is controlled by the control unit 20 as a function of signals from the print controller 12. The print controller 12 conveys digital signals representing the desired output image that is obtained from the print controller client 10. When exposed at the exposure station B, the photoreceptor surface is selectively discharged to a level of about −60V to −80V. Thus, after exposure, the photoreceptor belt 26 contains a monopolar voltage profile of high voltage, corresponding to charged areas, and low voltage, corresponding to discharged or background areas. This monopolar voltage profile forms the electrostatic latent image.

At the development station C, toner particles are provided that are attracted to the electrostatic latent image. In a known non-contact developer unit, a donor roller is powered by first field, which is an ac field adapted for toner cloud generation, and a second field, which is a dc field used to control the amount of developed toner mass on the photoreceptor surface. At the transfer station G, positive ions applied to the backside of the substrate S by the transfer unit 40 attract the negatively charged toner powder previously applied to the photoreceptor surface 26. In a typical system, the positive ions are generated by a transfer corotron that includes at least one wire, or coronode, which functions to generate electric fields. The necessary electrical field is provided by applying a particular bias to the corotron, which in the case of a transfer corotron is typically a substantially DC voltage or current bias. The actual voltage on the transfer corotron may be changed for different paper types and altitudes, etc., but the transfer current is typically kept constant. The magnitude of the positive transfer voltage may be approximately equal to the lower negative voltage at the imaging station, or between about +60V and +80V.

The detack unit 46 is also typically a corotron to which an electrical bias is applied. A common detack corotron is powered by an alternating current with a DC bias. The detack corotron is operable to generate an electrical field capable of neutralizing the charge on the substrate that attracts the substrate to the photoreceptor surface 26. More particularly, certain detack corotrons deposit both positive and negative ions onto the back of the substrate at the frequency of the line source until the net charge on the back of the sheet rapidly approaches the potentials on the photoreceptor surface 26. Once the potential is neutralized, the substrate tends to separate from the photoreceptor surface, sometimes assisted by a mechanical stripper inserted between the substrate and surface. The magnitude of the neutralizing potential may be approximately equal to the maximum negative potential at the imaging station, or between about It is known that higher neutralizing charges at the leading edge of the substrate will assist in stripping. On the other hand, it is also known that these higher detacking charges reduce the efficiency of the transfer unit 40, or lead to other undesirable effects such as image washout in the leading edge region or increased instability of the unfused transferred image on the substrate. There is a need for a system and method that can adjust the detacking levels to balance the need to assist in stripping a substrate from a photoreceptor surface and the desire to maintain the print quality as high as possible.

SUMMARY

In accordance with certain embodiments, a method is provided for assisting in stripping a substrate from a charge receptor that is operable to transfer marking material to the substrate at a transfer zone, comprising determining the solid area coverage of the transfer marking material at a leading region of the substrate at the leading edge thereof, moving the substrate through the transfer zone, and applying a stripping force to the leading region of the substrate as a function of the solid area coverage (SAC) operable to at least partially strip the leading region of the substrate from the charge receptor when the leading region of the traverses the transfer zone.

In other embodiments, the stripping force is also a function of a property of the substrate, such as its specific weight. In these embodiments, the stripping force is increased from a default level if the SAC is less than a lower coverage threshold value, but only if the specific weight of the substrate is less than a lower weight threshold value.

In still other embodiments, the stripping force is decreased is either the SAC is greater than a higher coverage threshold value, or the specific weight is greater than a higher weight threshold value. In these embodiments, the substrate with the transferred image is essentially self-stripping from the charged transfer surface.

One benefit of the disclosed embodiments is that the need for or magnitude of assistance in stripping a substrate from an image transfer device is based on the amount of image transferred and/or certain properties of the substrate itself. A further benefit is that the stripping assistance can be calibrated to optimize the ability to strip the substrate from the transfer device without sacrificing image quality.

DESCRIPTION OF THE EMBODIMENTS

Figure 1:
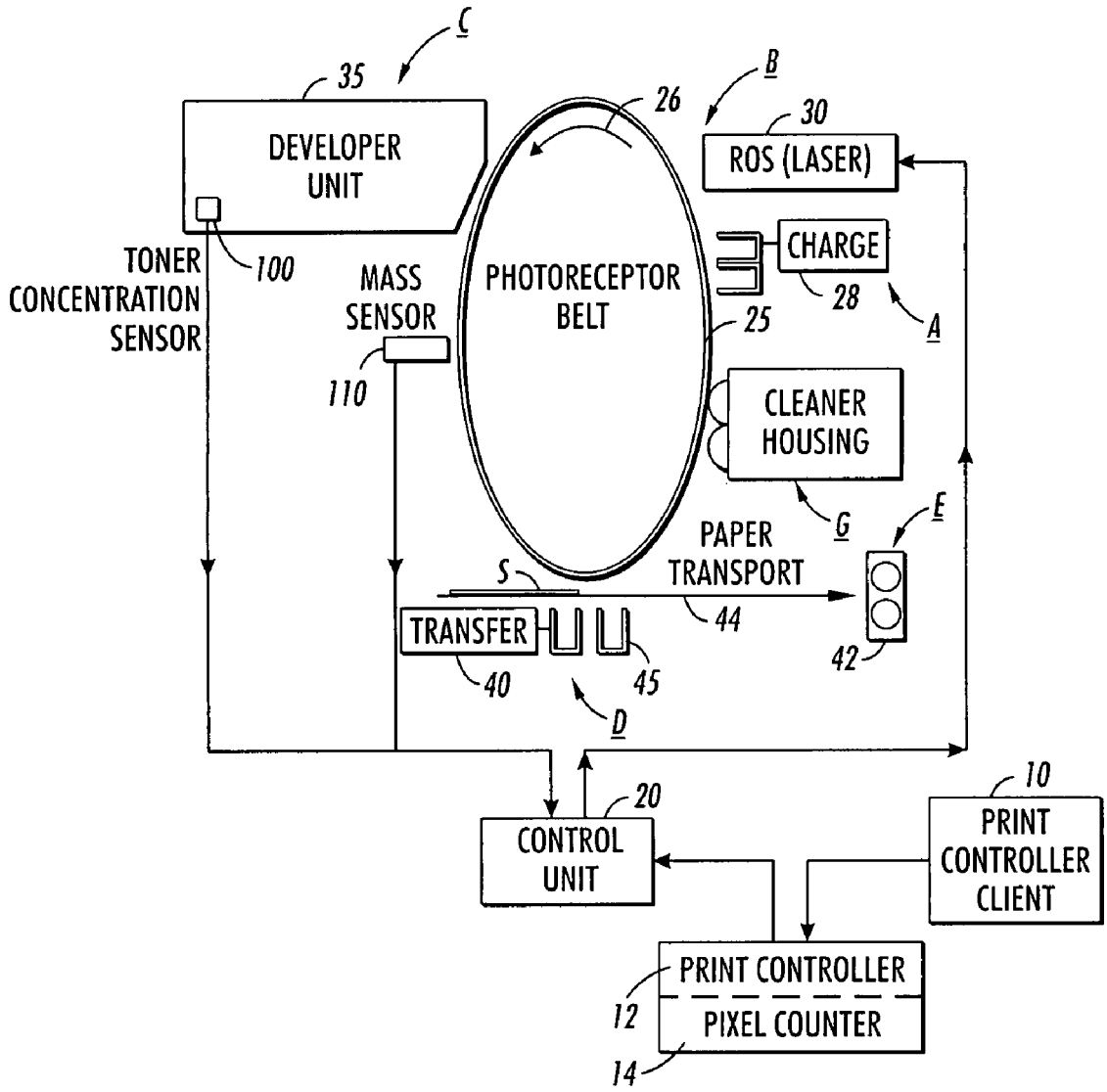
FIG. 1 is a partial schematic of an example of a print engine for a digital imaging system.

A system and method for stripping a substrate from an image transfer device contemplates first evaluating a leading region of the substrate to determine whether or how much image has been transferred to the substrate in that region. The leading region may be assigned a predetermined distance from the leading edge of the substrate in accordance with typical image transfer protocols. For instance, the leading region may be about 3.0 mm from the leading edge of the substrate based upon the assumption that most copying or printing does not occur in that region of the substrate. In a typical print engine, the leading region will exhibit a greater affinity for the charged receptor or photoreceptor surface 25 if little or no image has been transferred to that region of the substrate. It is known that where there is an image on the substrate, there is charged toner material forming that image, and that charged toner material can facilitate stripping of the substrate from the photoreceptor surface.

Consequently, knowing the solid area coverage (SAC) in the leading region of the substrate may be used to determine whether or how much stripping assistance is necessary to strip the leading edge of the substrate from the charged photoreceptor surface. In the typical print engine, nip rollers or other similar transport devices are available to receive the leading edge of the substrate, once the leading edge is available. Thus, in most cases, the need for assistance is limited to the leading region only of the substrate.

The SAC may be determined in any acceptable manner that is capable of ascribing a quantitative value to the SAC for the leading region. For instance, in one embodiment, the pixel counter 14 of the print controller 12 can provide information regarding the pixel count at each scanned line in the leading region. Since each pixel corresponds to an area of the substrate which will receive toner or other image transfer marking material, a count of the pixels in the leading region is representative of the solid area coverage. Various techniques may be employed to evaluate the pixel count, and ultimately the SAC, in the leading region. For instance, every image pixel may be counted and compared to a known value for the total number of pixels available in the leading region to produce an SAC ratio. Alternatively, only pixels in certain areas or in a certain pattern within the leading region may be evaluated to minimize the number of pixels that must be examined. As a further alternative, a random sampling pattern may be employed to provide a snapshot of the solid area coverage for the leading region. Regardless of the pixel counting approach, an SAC value is generated that is indicative of the image area transferred to the leading region when the substrate has been fully processed by the print engine.

Armed with a solid area coverage value, the control unit of the present embodiment can determine whether assistance is necessary to strip the substrate from the transfer unit, and if assistance is necessary, the magnitude of that assistance. In the print engine shown in FIG. 1, a detack corotron 45 provides a stripping force in the nature of a polarized field or charge applied to the backside of the substrate. This charge is calibrated to, at a minimum, neutralize the charge at the photoreceptor surface that attracts the substrate to the surface of the unit. Under certain conditions, the charge may exceed this minimum neutralization function and provide a charge sufficient to cause the substrate to be repelled from the photoreceptor surface.

The need for or the magnitude of any stripping assistance is also a function of the substrate material itself. For instance, a lighter weight substrate is more likely to curl when passing along the arcuate path of the photoreceptor surface (such as a photoreceptor belt or drum). On the other hand, a heavier weight substrate exhibits greater stiffness which reduces the amount that the substrate curls when passing through the photoreceptor surface. This greater stiffness also manifests itself in the heavier weight substrate tending to follow a tangential path upon exiting the photoreceptor surface. In the former instance (i.e., light weight material) greater stripping assistance is required, while in the latter case (i.e., heavier weight material) less stripping assistance is required. Some heavier specific weight substrates are self-stripping, requiring no stripping assistance.

Figure 2:
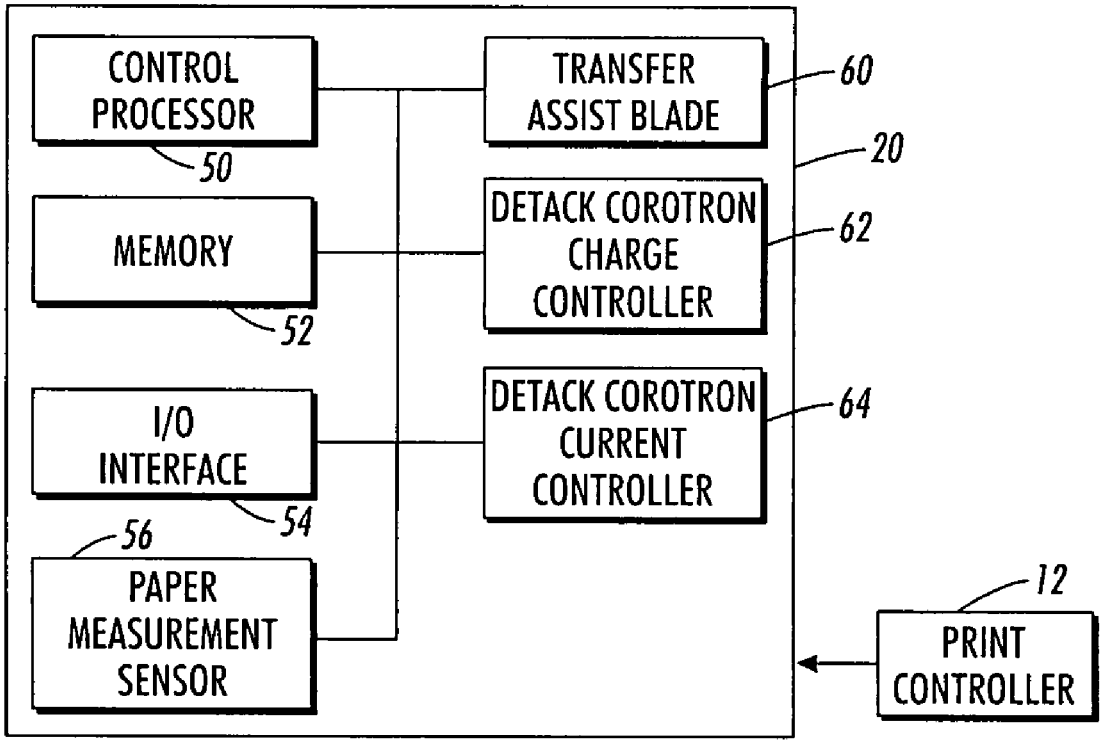
FIG. 2 is a block diagram of a control unit of one embodiment for use with the print engine shown in FIG. 1.

In the context of a corotron detack device, such as the device 45 of the system shown in FIG. 1, this variation in stripping assistance is a function of the detack level provided by the corotron. Thus, in one embodiment, the control unit 20 includes corotron controllers 62 and 64, as depicted in the block diagram of FIG. 2. The two controllers 62, 64 may be operated individually or collectively to control the detack charge generated by the detack corotron 45 in a known manner. In a typical print engine, the corotron (or coronode) current is increases to increase the detack charge generated by the corotron. In this embodiment, the control unit 20 includes a control processor 50 that receives information from the print controller 12, and particularly the image pixel information produced in the pixel counter 14. A memory 52 is provided to store data necessary for the control processor 50 to implement the corotron control protocols.

As explained above, the detack charge is a function of SAC and paper properties. The paper properties may be entered by the use through an I/O interface 54 allows user interface with the control processor or may be obtained through appropriate sensors 56. User input through the I/O interface 54 may constitute an indication of the type of substrate passing through the print engine—i.e., bond paper, card stock, etc. The memory 52 may include a table look-up to retrieve pertinent properties of the substrate based on this user input. Alternatively, or in conjunction therewith, on-board sensors 56 may sense the pertinent substrate property. It has been found that paper with a specific weight of 49-52 gsm is difficult to reliably strip off a photoreceptor belt or drum and transition to the paper transport path. Thus, in a preferred embodiment, the substrate property is specific weight, since that property has been found to provide an acceptable indication of the detack level necessary to assist in stripping the substrate from the photoreceptor surface.

Figure 3:
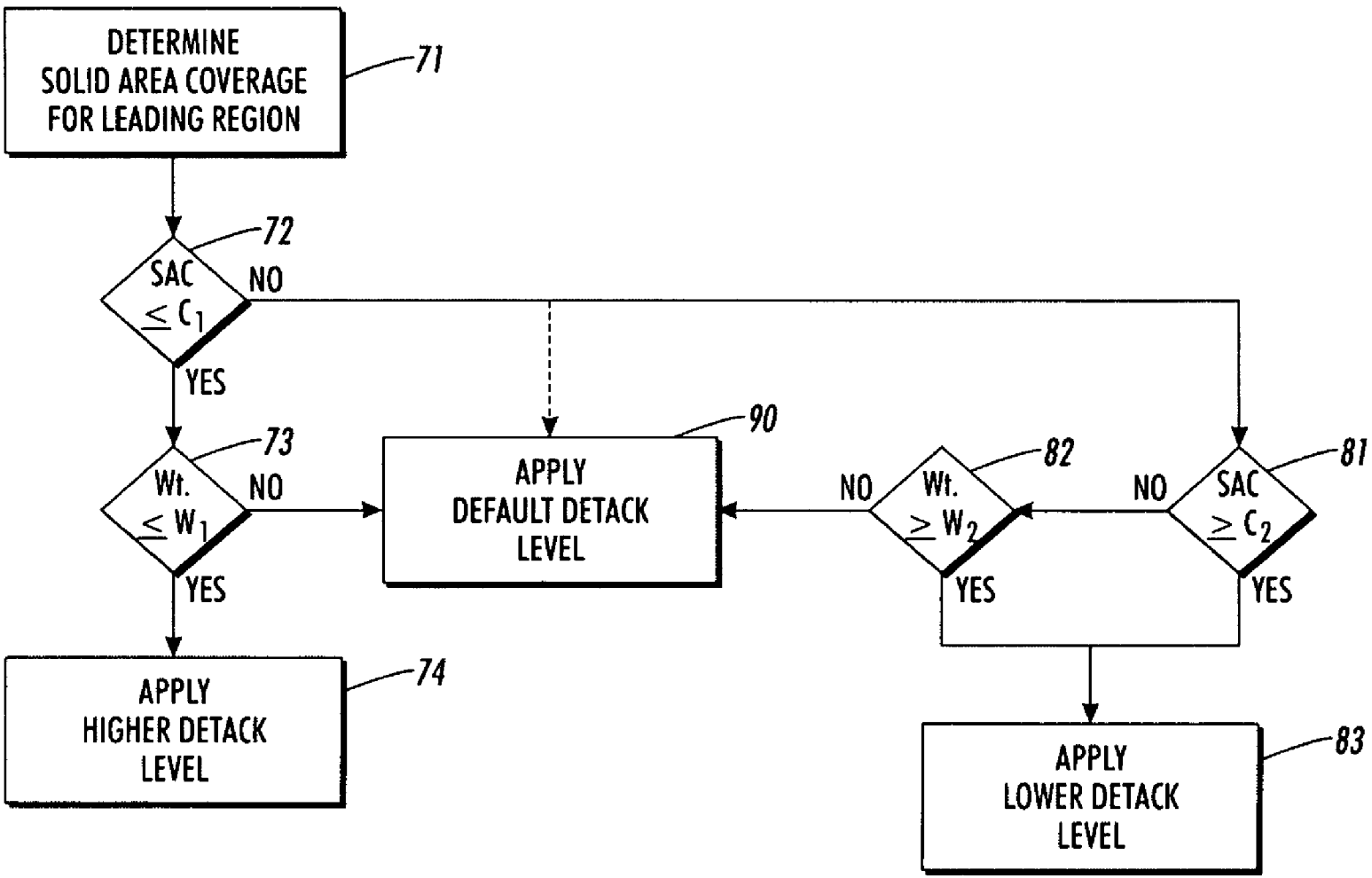
FIG. 3 is a flowchart of a method of one embodiment of the present disclosure.

The control processor 50 implements a series of commands, as reflected in the flowchart of FIG. 3. The first step 71 involves determining the solid area coverage (SAC) for the leading region of the substrate. The leading region may be variably defined, as explained above, as function of the print controller client and the nature of the image transfer. The definition of the leading region may be based on user input through the I/O interface 54, or obtained from a table look-up based on information obtained from the print controller 12 or the I/O interface 54. In one embodiment, the leading region is pre-defined as the leading 3.0 mm of the substrate. Thus, in step 71, the SAC for this initial 3.0 mm is obtained from the pixel count information as described above.

In conditional step 72, a determination is made as to whether the SAC value is less than or equal to a threshold coverage area value $C_1$. This threshold value $C_1$ may be pre-defined to correspond to a certain coverage value that has been determined to require assistance in stripping the substrate. In a specific example, it has been found that paper with a leading region solid area coverage of less than about twenty percent (20%) is often difficult to reliably strip from the photoreceptor surface 25, at least without some negative impact on the image quality in that leading region. Thus, the pre-defined threshold value $C_1$ can be twenty percent. Alternatively, this lower end threshold value $C_1$ may be separately input through the print controller 12 or I/O interface 54, or obtained form another table look-up in memory 52 based on the substrate of nature of the image transfer.

If the SAC determined in step 71 is greater than the lower threshold value $C_1$, then the leading region will have enough image (i.e., toner) transferred to the region that additional stripping assistance is not required. In one embodiment, the control processor 50 can apply the default detack level, as indicated in step 90, in which the corotron controllers 62 and 64 are operated to apply a default detack field to the substrate.

If the SAC is found in comparison step 72 to be equal to or less than the threshold value $C_1$ then it is necessary to determine whether the properties of the substrate are such that additional stripping assistance is necessary. As explained above, one substrate property is specific weight, which determines paper stiffness and affinity to curl when passing through a duplex path. Thus, in conditional step 73 the specific weight of the substrate is compared to a lower threshold weight value $W_1$. If the specific weight of the substrate exceeds that threshold $W_1$ then control passed to step 90 in which the default detack level is applied by the control processor 50. In other words, even if the SAC in the leading region is minimal, no stripping assistance is called for if the substrate specific weight is sufficiently high that the natural stiffness and resistance to curling allows the use of the default detack level.

On the other hand, if the substrate specific weight falls below the weight threshold $W_1$ detack assistance is required. Control thus passes to step 74 in which the control processor 50 directs the corotron controllers 62/64 to apply a higher detack level to the backside of the substrate. This increased detack level may be a fixed pre-determined level that is implemented by increasing the corotron current at controller 64 to a pre-determined value greater than the default detack current. In certain embodiments, it has been found that a detack level that is about eighty percent (80%) of the transfer level (at the transfer corotron 40) is suitable to improve the stripping or detack performance for a 49 gsm paper. In these certain embodiments, the default detack level is typically about fifty percent (50%) of the transfer level.

Figure 4:
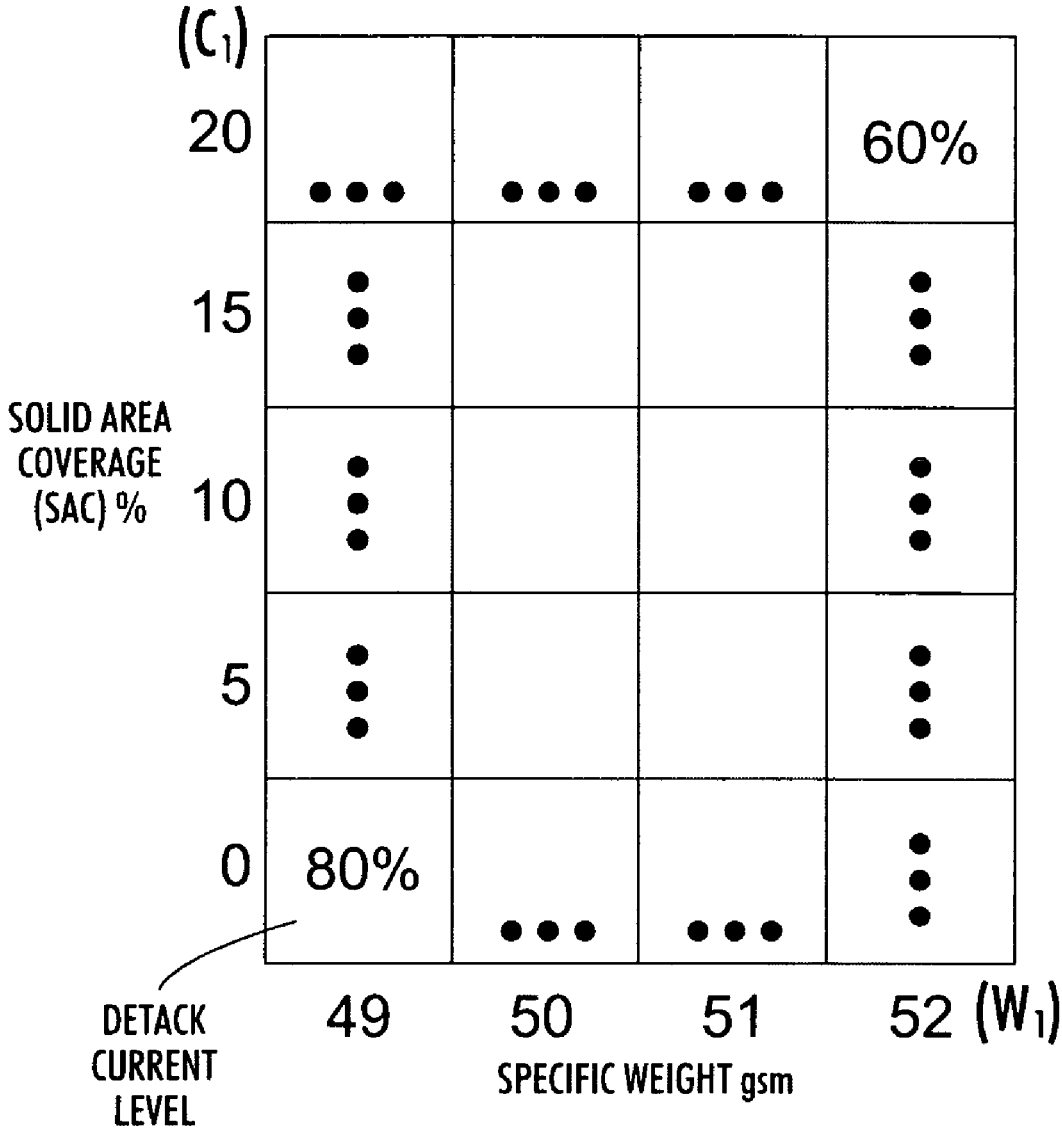
FIG. 4 is a diagram of a table look-up implemented in the process steps shown in the flowchart of FIG. 3.

In another embodiment, the increased detack level is obtained from a table look-up stored in memory 52. This table look-up can provide a corotron current level as a function of both solid area coverage (SAC) value and specific weight (Wt.) value, as depicted in FIG. 4. This stored current level value may be a current magnitude, a delta value from the default current or some other value usable by the corotron controllers 62, 64 to control the detack corotron. In the table look-up illustrated in FIG. 4, the level value is a percent of the transfer detack current. In the illustrated example, the detack current level is greatest at the lowest paper specific weight and lowest solid area coverage (corresponding to no image) at the leading region. The table-look-up value is lowest at the two threshold values—i.e., $W_1$ and $C_1$. It is understood that the detack current level values in the look-up table may be different from those shown in the illustration and may be determined empirically. In addition, the table of FIG. 4 may include more entries than shown corresponding to smaller increments in the SAC or specific weight axis values. Moreover, it is contemplated that the control processor 50 may implement known techniques to obtain a look-up value where an SAC or weight value is not identical to one of the table axis values.

It is contemplated that the relationship between detack current level and the two variables, SAC and specific weight, may also be susceptible to definition in an algorithm. In other words, an algebraic equation may be used to calculate the detack level, in lieu of the table look-up approach.

Returning to the flowchart of FIG. 3, the present embodiment may also incorporate means to reduce the detack level at the stripper corotron 45. Thus, if the result of the conditional 72 is that the solid area coverage exceeds the lower threshold, the control processor 50 can proceed to the next conditional at step 81 in which the SAC value obtained in step 71 is compared to an upper coverage threshold value $C_2$. If the leading region is substantially filled with the transferred image (i.e., toner) then less detack force is necessary to cause the substrate to release from the photoreceptor surface 25. In accordance with the present embodiment, if the SAC exceeds this upper threshold then the control processor applies a lower detack level in step 83. The lower detack level 83 is manifested in a signal provided by the control processor to the corotron controllers 62, 64 in the manner described above. However, unlike the low SAC condition, the goal in this branch of the printer control is to reduce the stripping force or detack field to reduce the risk of reduction of image quality. As explained above, it is know that detack charge can reduce image quality, so the present invention contemplates reducing detack charge where the default level is not needed to strip the substrate from the photoreceptor surface 25.

In step 83, the lower detack level may be obtained from a table look-up. The table implemented in step 83 may be similar to the table in FIG. 4, except that a single variable—solid area coverage—is used. It is understood that the detack current levels in this table look-up will be less than the default current levels. As an alternatively, an algorithm may be devised to relate higher solid area coverage values to reduced detack levels.

If he SAC does not exceed the upper threshold value $C_2$, a determination of the specific weight of the paper is made in conditional step 82. If the specific weight exceeds an upper threshold value $W_2$ a lower detack level may be applied in step 83. As indicated above, higher weight substrates are less susceptible to curling and the increased substrate stiffness provides some inherent ability to release from the photoreceptor surface. Just as greater SAC warrants a lower detack level, so too does a heavier substrate sheet. A table look-up or algorithm may be used to obtain a value for the reduced detack level to be supplied to the detack controllers 62, 64.

As reflected in FIG. 3, if the SAC does not exceed the upper threshold $C_2$ and the specific weight does not exceed the upper weight threshold $W_2$, then the default detack level is applied by the control processor.

In certain print engines, a transfer assist blade is provided to assist in stripping the substrate from the photoreceptor surface. In accordance with a further embodiment, the control processor 50 may control the operation of the transfer assist blade 60. More particularly, the control processor 50 may determine circumstances in which the transfer assist is not necessary, such as when the solid area coverage in the leading region exceeds a threshold or when the substrate properties are such that the substrate separates itself from the photoreceptor. Thus, in accordance with this embodiment, the control processor 50 executes the step of determining the solid area coverage, corresponding to step 71 in the flowchart of FIG. 3. For this embodiment, the processor may execute the conditional step 72 or process flow may pass directly to either or both of the conditional steps 81 and 82. In step 81, the processor determines whether the SAC exceeds the upper threshold coverage value $C_2$, while conditional step 82 involves an evaluation of specific weight of the substrate is relative to the upper weight value $W_2$.

The threshold values $C_2$ and $W_2$ may be the same as described above with respect to the detack control, or different threshold values may be applied, If either conditional 81 or 82 is answered yes, meaning that the corresponding threshold value has been exceeded, then the control processor 50 issues a hold command to the transfer assist blade 60. Thus, in this embodiment, step 83 may be modified to indicate the issuance of this hold command by the control processor. It is understood that this transfer assist blade hold command may be issued concurrently with the application of the lower detack level.

It will also be appreciated that various of the above-diclosed and other features and functions, or alternatives thereof, may be desirably combined into many other different systems or applications. Various presently unforeseen or unanticipated alternatives, modifacations, variations, or improvements therein may be subsequently made by those skilled in the art which are also intended to be encompassed by the following claims. For instance, knowledge of the leading region solid area coverage may be used to adjust other operating parameters of the print engine.

What is claimed is:

1. A method for assisting in stripping a substrate from a charge receptor that is operable to transfer marking material to the substrate at a transfer zone, comprising:

determining solid area coverage of the transfer marking material at a leading region of the substrate at a leading edge thereof;

moving the substrate through the transfer zone; and applying a stripping force to the leading region of the substrate as a function of the solid area coverage operable to at least partially strip the leading region of the substrate from the charge receptor when the leading region of the substrate traverses the transfer zone.

2. The method of claim 1, wherein the stripping force is generated by a device operable to provide a charge to the substrate sufficient to electrically neutralize portions thereof.

3. The method of claim 2, wherein the stripping force is generated by a corotron and the stripping force is a function of a corotron current.

4. The method of claim 3, wherein a magnitude of the corotron current is a function of the solid area coverage.

5. The method of claim 4, wherein the corotron current has a default value and the function of the solid area coverage (SAC) increases the corotron current from that default value when the SAC is less than a lower coverage threshold value.

6. The method of claim 4, wherein a magnitude of the corotron current is also a function of a property of the substrate.

7. The method of claim 6, wherein the property of the substrate is a specific weight of the substrate.

8. The method of claim 7, wherein the corotron current has a default value and the function of the solid area coverage (SAC) increases the corotron current from that default value when the SAC is less than a lower coverage threshold value only if the specific weight of the substrate is less than a lower weight threshold value.

9. The method of claim 8, wherein the corotron current is obtained from a table look-up in relation to the solid area coverage and the specific weight of the substrate.

10. The method of claim 7, wherein the corotron current has a default value and the function of the solid area coverage (SAC) decreases the corotron current from that default value when the SAC is greater than a higher coverage threshold value.

11. The method of claim 7, wherein the corotron current has a default value and the function of the solid area coverage (SAC) decreases the corotron current from that default value when the specific weight of the substrate is greater than a higher weight threshold value.

12. The method of claim 1, wherein a magnitude of the stripping force is a function of the solid area coverage.

13. The method of claim 12, wherein the stripping force is also a function of at least one property of the substrate.

14. The method of claim 13, wherein the property is a specific weight of the substrate.

15. The method of claim 14, wherein the magnitude of the stripping force has a default value and the function of the solid area coverage (SAC) increases the stripping force from that default value when the SAC is less than a lower coverage threshold value only if the specific weight of the substrate is less than a lower weight threshold value.

16. The method of claim 15, wherein the magnitude of the stripping force is obtained from a table look-up in relation to the solid area coverage and the specific weight of the substrate.

17. The method of claim 1, wherein the leading region is a predetermined distance from the leading edge.

18. The method of claim 17, wherein the predetermined distance is about 3.0 mm.

19. The method of claim 1, wherein the stripping force is applied by a control processor selectively operating a transfer assist blade.

20. The method of claim 19, wherein the control processor selectively operates the transfer assist blade by issuing a hold command in response to the solid area coverage exceeding a threshold coverage value.

* * * * *